US006451399B1

(12) United States Patent
Boyce

(10) Patent No.: US 6,451,399 B1
(45) Date of Patent: Sep. 17, 2002

(54) DISPLAY MAT

(76) Inventor: Daniel G. Boyce, 2304 169th Ave., NE., Ham Lake, MN (US) 55304

( * ) Notice: Subject to any disclaimer, the term of this patent is extended or adjusted under 35 U.S.C. 154(b) by 95 days.

(21) Appl. No.: 09/775,522

(22) Filed: Feb. 5, 2001

(51) Int. Cl.[7] ..... G09F 1/12

(52) U.S. Cl. ..... 428/43; 428/138; 428/201; 40/735; 40/124.01

(58) Field of Search ..... 428/43, 138, 195, 428/201; 40/124.01, 124.191, 735, 768

(56) References Cited

U.S. PATENT DOCUMENTS 6,073,379 A * 6/2000 Boyce ..... 40/735

* cited by examiner

*Primary Examiner*—Alexander S. Thomas
(74) *Attorney, Agent, or Firm*—Herman H. Bains

(57) ABSTRACT

A display mat includes a display panel and a backing panel having a photographic print and a verse panel positioned therebetween. The display panel has a plurality of symmetrical display openings therein through which the photographic print and verse panel are displayed. The symmetrical display openings may be of different sizes and shapes and the number of display openings may vary. A verse panel is provided and has the verse applied to one surface thereof in two locations arranged ninety degrees with respect to each other for selection of a verse to fit and match a symmetrical display opening in the display panel.

5 Claims, 3 Drawing Sheets

DISPLAY MAT

FIELD OF THE INVENTION

This invention relates to a display mat having a plurality of symmetrical openings therein for selectively displaying photographic prints and written verse material therein.

BACKGROUND OF THE INVENTION

In my U.S. Pat. No. 6,073,379, a display mat having a plurality of symmetrical openings therein for accommodating photographic prints and verse panels is disclosed. The photographic print and verse panel are interchangeable with respect to the openings and are hinged to the display panel. The openings in the display panel are of oval and rectangular configuration and are of substantially the same size (area). While the hinge attachment style in my prior patent functions satisfactorily, assembly of this system is somewhat time consuming.

SUMMARY OF THE INVENTION

It is an object of this invention to provide a display mat having a plurality of different symmetrical openings therein for displaying photographic prints and verse panels. The openings in the display mat may be rectangular, oval, square, pentagonal, or any other symmetrical geometrical shape. The verse panel has two written verses thereon which are arranged at right angular relation with respect to each other. The verse panel and photographic print are interchangeable with respect to the different symmetrical openings. The verse panel may be selectively displayed in opening, regardless of the orientation of the opening, such that the verse information may be coherently perceived.

DESCRIPTION OF THE PREFERRED EMBODIMENT

Figure 1:
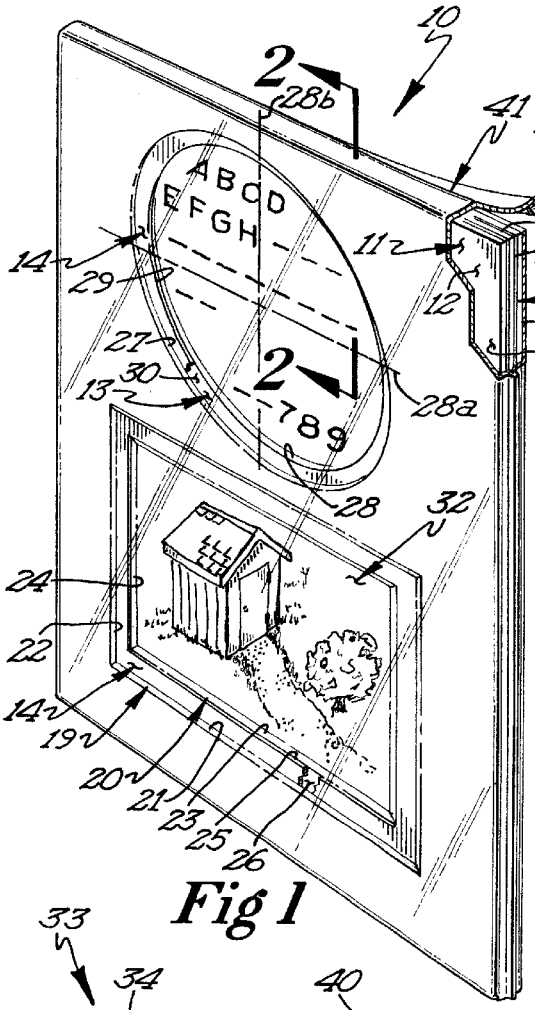
FIG. 1 is a front perspective view of the display mat with certain parts thereof broken away and folded for clarity.
Figure 2:
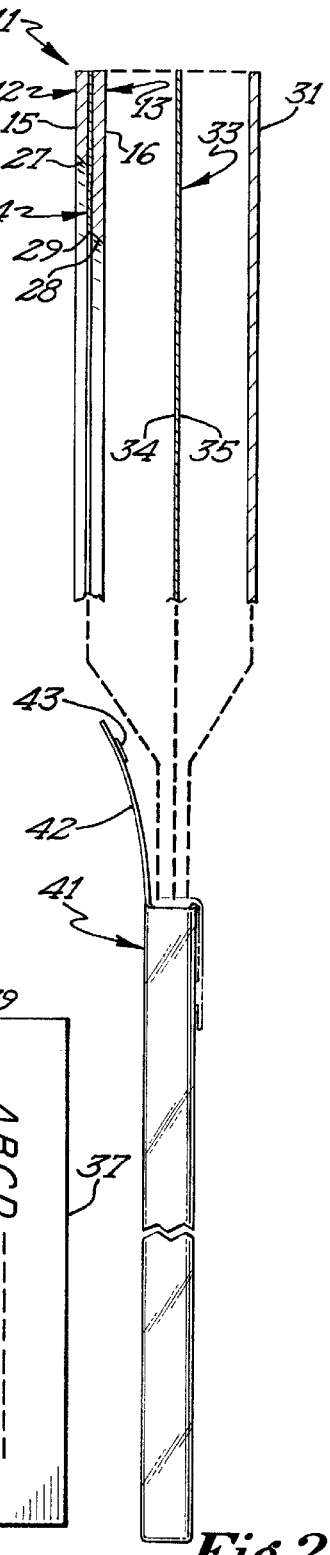
FIG. 2 is a exploded side view of the display mat with a cross-section taken along line 2—2 of FIG. 1 and looking in the direction of the arrows.
Figure 3:
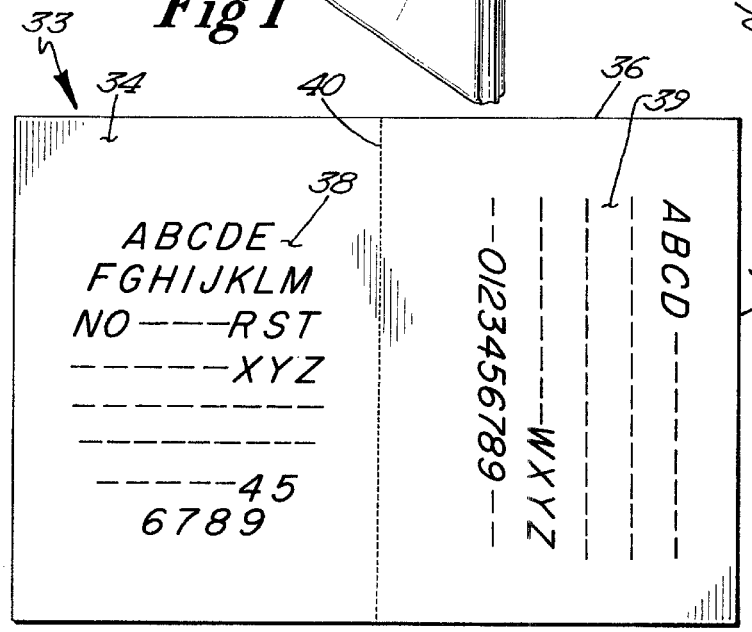
FIG. 3 is a front elevational view of a verse panel.

Referring now to drawings, and more particularly to FIG. 1–3, it will be seen that one embodiment of the novel display mat, designated generally by the reference numeral 10, is thereshown. The display mat 10 is of rectangular configuration and is comprised of a rectangular display panel 11 which, in the embodiment shown, is formed of a front ply or panel 12 and a rear ply or panel 13. An intermediate or colored sheet 14 is positioned between the front and rear plies.

The display panel 11 has a front surface 15, a rear surface 16, longitudinal edges 17 and transverse edges 18. The front ply 12 of the display panel 11 has a rectangular opening 19 therein, and the rear ply 13 has a rectangular opening 20 therein. It will be noted that the rectangular opening 20 is smaller in size than the opening 19. It will further be noted that the opening 20 is centered with respect to opening 19.

The opening 19 is defined by longitudinal edges 21 and transverse edges 22. The opening 20 is defined by longitudinal edges 23 and transverse edges 24. The intermediate sheet 14 also has rectangular opening 25 therein which is identical in size to the opening 20. The opening 25 in the intermediate sheet 25 is disposed in registering relation with the opening 20 to thereby define a colored rectangular surface 26 which displays and frames the opening 20.

The front ply 12 of the display panel 11 has an oval opening 27 therein and the rear ply 13 has an oval opening 28 therein. The opening 28 is centered with respect to the opening 27. The intermediate sheet 14 has an oval opening 29 therein which is of the same size as opening 28. The opening 29 in the intermediate sheet is disposed in registering relation with opening 28 to thereby define an annular surface 30 of the intermediate sheet 14 framing the opening 28. The display mat 10 is also includes a rectangular backing panel 31 which corresponds in size and shape to the display panel 11.

A photographic print 32 is provided and is positioned in the display panel to face forwardly or outwardly. The print 32 may be selectively positioned in either the oval or rectangular opening between the display panel and backing panel.

A verse panel 33 is also provided and is of rectangular configuration as shown in FIG. 3. The verse panel 33 has a front surface 34, a rear surface 35, longitudinal edges 36 and transverse edge 37. The front surface 34 of the verse panel has a written verse or information 38 printed or otherwise applied thereto. The verse 38 is oriented vertically so that the lines are horizontally. The verse 38 may be positioned in either opening in the display panel depending on the orientation of the display panel.

The verse panel 33 also has a verse 39 printed thereon, and the lines of the verse 39 are arranged generally parallel to the transverse edges 37. Again, the verse 39 may be positioned in either opening depending on the orientation of the display panel.

The verse panel is also provided with a cut line 40 extending between the longitudinal edges 36 transversely of the pages. A consumer or user may simply cut the panel 33 along the cut line 40 and select the verse orientation for the chosen display opening.

A transparent cover or pouch 41 is provided and contains the display panel, backing panel, photographic print and verse panel 4I (portion). The 41 has a closure flap 42 for closing the cover. It is pointed out that the display mat 10 may be marketed without a cover 41. The display mat may be sold in or with a conventional picture frame or any conventional marketing style. The display panel 11 may be of single ply such that the display mat will consist of a display panel and backing panel. A verse panel or panels will be provided with each display mat.

Figure 4:
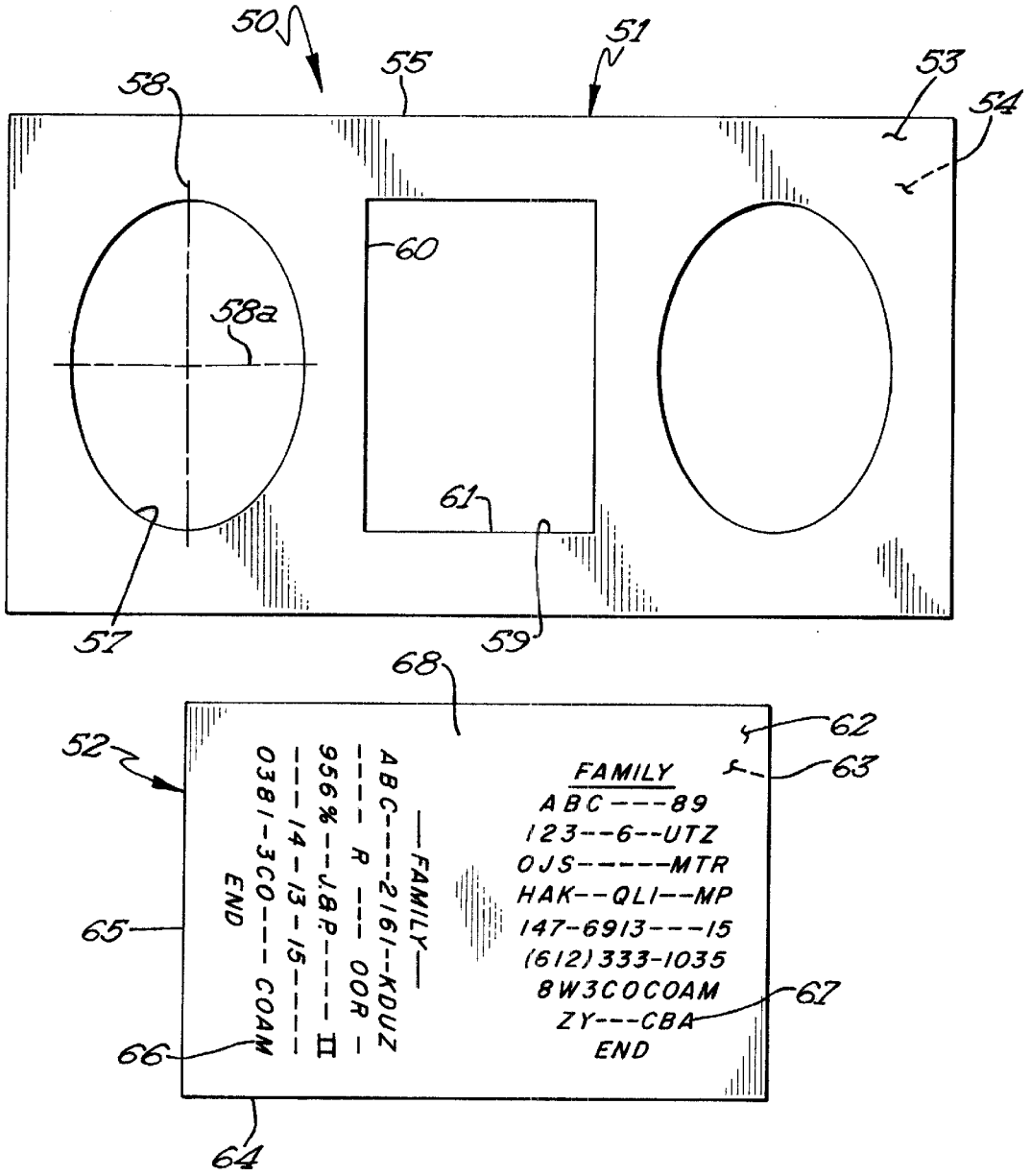
FIG. 4 is a front elevational view of a modified form of the display mat showing the display panel and a verse panel.

It is pointed out that each display mat may be provided with two or more openings and these openings may have different symmetrical configurations. Referring now to FIG. 4 it will be seen that a different modification of the display mat 50 is thereshown. In the embodiment shown in FIG. 4, only the display panel 51 of the display mat 50 is shown with the verse panel 52. It is pointed out the display mat 50 will have a backing panel and may or may not have a transparent cover. The display panel may be of single ply or may include front, rear and intermediate plies in the manner of FIG. 1.

In the embodiment shown, only a single ply display panel 51 is shown and has a front surface 53, rear surface 54, longitudinal edges 55 and transverse edges 56. The display panel 51 has a pair of oval openings 57 therein and a rectangular opening 59 therein. Oval openings 57 each has a major axis 58 and a minor axis 58a. The rectangular opening 59 is defined by longitudinal edges 61 and transverse edges 62.

The rectangular opening 59 is centered with respect to the display panel and is positioned between the oval openings 57. However, other arrangements of openings may also be used and other symmetrical openings may also be employed.

The verse panel 52 is of rectangular configuration and has a front surface 62, a rear surface 63, longitudinal edges 64, and transverse edges 65. A written verse 66 is printed or otherwise affixed to the front surface 62 of the verse panel. The lines of the verse 66 are arranged in the direction of a substantially parallel to the transverse edges 65. The verse panel 52 also has the verse 67 printed thereon but the lines of verse 67 are arranged in the direction of the longitudinal edges 64 and substantially parallel thereto.

It will be noted that the verses 66 and 67 are spaced apart to define a cut zone therebetween. The verse panel may be cut through the cut zone 68 along a line parallel to the transverse edges 65 to separate the verse panel into two parts. A user may select one of the verses for proper orientation in one of the oval openings 57 or the rectangular opening 59. It will be appreciated that any arrangement of verses and/or photographs may be used. It will also be appreciated that the display mat in all of the embodiments may be rotated ninety degrees from the position shown in the drawings for presentation.

Figure 5:
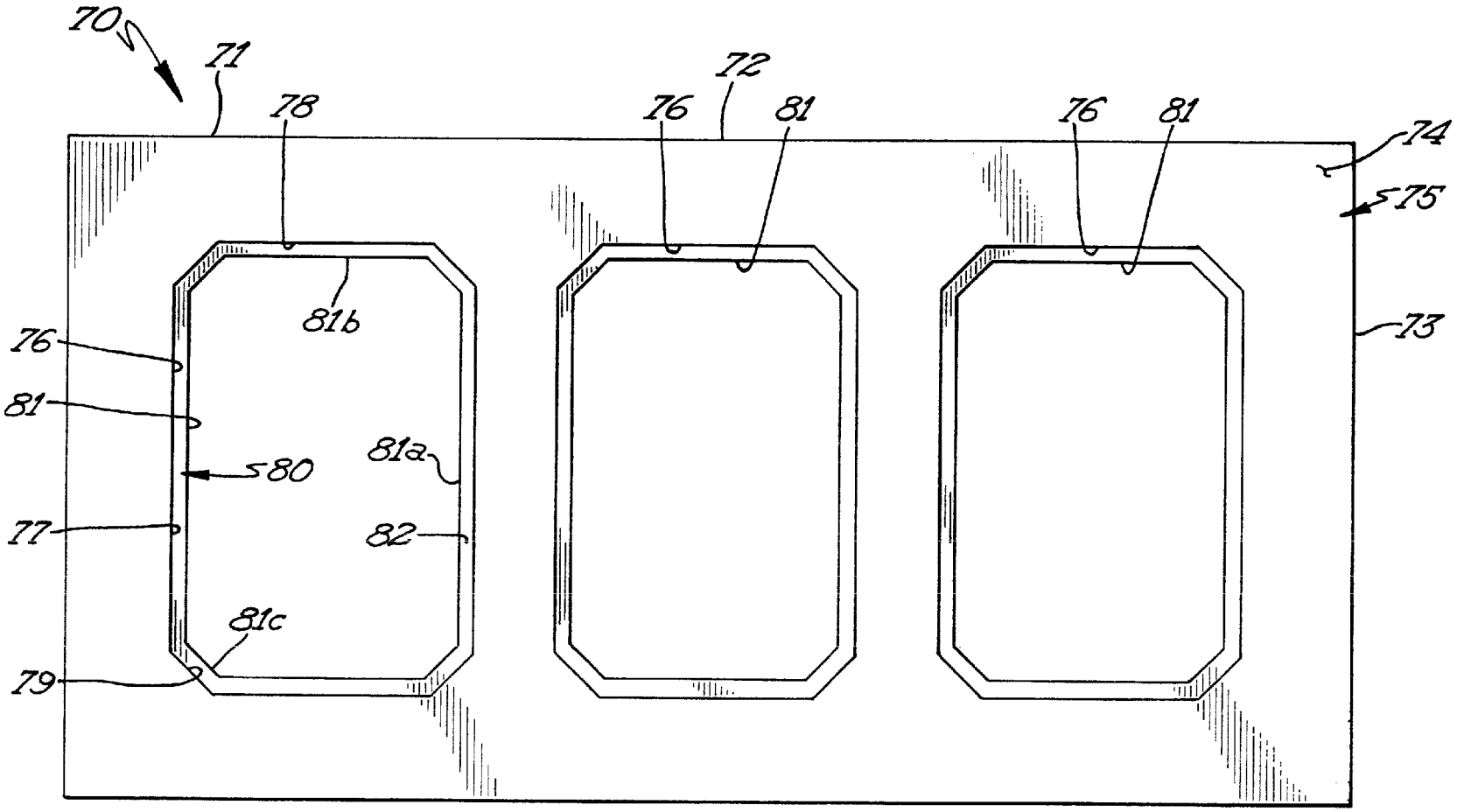
FIG. 5 is a front elevational view of a further modification of the display mat.

Referring now to FIG. 5, it will be seen that another embodiment of the display mat 70 is thereshown. The display mat 70 includes a display panel 71 which has a plurality of plies including a front ply 75, an intermediate ply 80, and a rear ply (not shown). The display mat will also include a backing member (not shown) and may or may not have a transparent cover of the type shown in FIG. 1. The display panel 71 has longitudinal edges 72, transverse edges 73, a front surface 74 and a rear surface 75.

The display panel 71 has a plurality of symmetrical display openings therein, which, in the embodiment shown, consists of three octagonal openings. The openings in the display panel are defined by openings in the respective plies. The front ply 75 has three octagonal openings 76 defined by vertical or transverse edges 77, longitudinal edges 78 and corner edges 79.

It will note that the openings 76 have a general rectangular shape with truncated corner edges 79 to impart an octagonal shape to the opening. The intermediate ply 80 also has a slightly smaller octagonal opening 81 defined by transverse edges 81*a*, longitudinal edges 81*b* and corner edges 81*c*. The rear ply (not shown) will also have octagonal openings therein disposed in registering relation with the openings 81 in the intermediate ply 80. Since the openings 81 in the intermediate ply is somewhat smaller than the openings 76 in the front ply 75, an octagonally shaped framing surface 82 is defined and faces forwardly or outwardly.

The octagonal opening in the display mat 70 will accommodate photographic prints and a verse or verses. The display mat 70 will be provided with a verse panel such as that shown in FIGS. 3 and 4. The display mat 70 may be oriented in the position shown in FIG. 5 or it may be rotated ninety degrees for presentation. The photographs and verse panel will also be positioned for coherent viewing.

It is pointed out that the photographs and verse panel (after cutting) will be positioned for display in the openings in the mat between the display panel and backing member. It will not be necessary to attach or hinge the photographs and verse panels to the display panel or backing panel. Since the verse panel and photographs do not have to be attached to the display panel or backing panel, the time and effort for assembling the mat is diminished.

It is pointed out that the embodiments shown are merely representative of the shapes and numbers of display openings for the display mat. It will be appreciated that the openings in a mat may also vary in size. Some openings may be smaller or larger than other openings.

The arrangements of the openings in the display mat must be balanced, i.e., symmetrical. The openings must also be symmetrical. Symmetry as used herein is the conventional meaning.

It is pointed out that one of the features of the present invention is the provision of a verse panel having the verse applied to a surface of the verse panel at two locations arranged ninety degrees from each other. The lines of one verse will be disposed substantially parallel to the longitudinal edges of the verse panel while the lines of the other verse will be arranged substantially parallel to the transverse edges of the verse panel.

The verses are spaced apart on the verse panel to define a cut line or a cut zone to allow a user to select the verse to be used. The selection of the particular verse to be used depends on particular opening displaying the verse and/or the orientation of the display mat. It is pointed out that the width dimension and vertical dimension of each verse varies with respect to the width and vertical dimension of the other verse on the same panel. Therefore, for proper display, selection or matching of a verse to the opening is required.

Another feature of the present invention is the ability to position the verse and photographic print or prints in proper display position between the display panel and backing panel without hinging or otherwise attaching the print or verse to either panel. This feature diminishes the time required for production of the novel display mats.

From the foregoing description, it will be seen that I have provided a novel and unique display mat containing a verse panel and at least one photograph, the verse panel, photograph and display mat being capable of various orientations by a user.

What is claimed is:

1. A display mat for selectively displaying a photograph and a verse panel having a written verse on one surface thereof, comprising a rectangular display panel having a plurality of symmetrical openings therein, said display panel having a front surface, rear surface, longitudinal edges and transverse edges, a rectangular backing panel corresponding in size and shape to said display panel, a rectangular shaped photographic print having a size greater than the area defined by each symmetrical opening in the display panel, a rectangular verse panel having opposed surfaces, longitudinal edges and transverse edges, two verses affixed to one surface of the verse panel, each verse consisting of lines, the lines of one verse being arranged substantially parallel to the longitudinal edges of the verse panel, the lines of the other verse being arranged substantially parallel to the transverse edges of the verse panel, the verses of a panel being spaced apart to define a cut zone between the verses for use in separating the verse panel into two parts whereby a user may select a part of the cut verse panel for display through a selected opening in the display panel, the disposition of the photograph and verse panel part depending on the orientation of the openings in the display panel and the orientation of the display panel, each photograph and verse panel part being clamped between the display panel and backing panel.

2. The display mat as defined in claim 1 wherein the display panel has more than two openings therein.

3. The display mat as defined in claim 2 wherein said openings are of identical size and shape.

4. The display mat as defined in claim 1 wherein the cut zone of the verse panel has a cut line thereon.

5. The display mat as defined in claim 1 wherein said display panel is constructed of a front ply, a rear ply, and an intermediate ply, each ply having display openings therein, the display openings in said intermediate and rear plies being of the same size, and the opening in the front ply being larger in size than the openings in the rear and intermediate plies, the intermediate ply having an outwardly facing front surface defining a framing surface.

* * * * *